US005619923A

United States Patent [19]

Kotterer

[11] Patent Number: 5,619,923

[45] Date of Patent: Apr. 15, 1997

[54] DEVICE FOR PREVENTING DAMAGE IN PRINTING UNITS

[75] Inventor: Werner J. Kotterer, Diedorf, Germany

[73] Assignee: Acrotec GmbH, Diedorf, Germany

[21] Appl. No.: 511,071

[22] Filed: Aug. 3, 1995

[30] Foreign Application Priority Data

Sep. 14, 1994 [DE] Germany ..... 44 32 659.9

[51] Int. Cl.[6] ..... B41F 13/60

[52] U.S. Cl. ..... 101/226; 101/484

[58] Field of Search ..... 101/226, 484, 101/224; 226/11

[56] References Cited

U.S. PATENT DOCUMENTS

| | | | |
|---|---|---|---|
| 2,683,195 | 7/1954 | Howdle et al. | 226/11 |
| 2,821,914 | 2/1958 | Schuba | 101/224 |
| 4,532,500 | 7/1985 | Henk | 226/11 |
| 4,549,485 | 10/1985 | Nawrath | 101/219 |
| 4,846,060 | 7/1989 | Proctor | 101/228 |
| 4,887,532 | 12/1989 | Kotterer | 101/225 |
| 5,063,845 | 11/1991 | Perretta | 101/224 |
| 5,163,371 | 11/1992 | Kotterer et al. | 101/484 |
| 5,365,843 | 11/1994 | House et al. | 101/228 |
| 5,398,610 | 3/1995 | Pavliny et al. | 101/484 |

*Primary Examiner*—Edgar S. Burr
*Assistant Examiner*—Daniel J. Colilla
*Attorney, Agent, or Firm*—Harrison & Egbert

[57] ABSTRACT

In the context of a device for preventing damage to a rotary printing press comprising a dryer owing to tearing of the web being processed, a high degree of safety is achieved if such device comprises a web catching device, a severing and halting device arranged following the web catching device in the direction of web travel, such web catching device and such severing and halting device being arranged between a last printing unit of the printing press and the dryer, and a web tear detector adapted to cause operation in sequence of the web catching device and the severing and halting device.

6 Claims, 2 Drawing Sheets

DEVICE FOR PREVENTING DAMAGE IN PRINTING UNITS

BACKGROUND OF THE INVENTION

The invention relates to a device for preventing damage to a rotary printing press comprising a dryer owing to tearing of the web being processed.

THE PRIOR ART

Web catching devices have been proposed for use between the last printing unit and the dryer, in the case of which the web of material being processed is wound up on a take up roll, should a tear occur. Since the web being processed as a rule tears in the dryer, both the length of material present between the printing units and also the length in the dryer will be wound up on the take up roll. The length of material web returning from the dryer is frequently crinkled, more particularly in the case of high speed machines with long dryers. This is responsible for variations in the diameter of winding along the width of the take up roll. As a result there is a one-sided pulling action by the web catching device on the length of the web being processed, which is between the draw in mechanism and the web catching device. However with such a one-sided pull by the web catching device there will be serious danger of tearing in such length, because on the one side with less pull a loose loop may be produced leading to the danger of the web's coiling up on the roll and the consequent danger of a tear in the drawing in mechanism. In any case the tear will be an uneven one. There is the additional hazard that the tail, produced during tearing, of the length taken up by the web catching device will come into contact with a cylinder of the printing press. Then small pieces of paper will be torn off which foul the equipment. If furthermore the crinkling of the length returned from the dryer is so large that such crinkled portion jams the web catching device at its narrowest point, the motor of the web catching device must act with an increased torque. The consequence of this is that the speed drops. If the speed of coiling of the take up roll is less than the speed of the length, released by the draw in mechanism, of the web being processed, a pocket will be formed. This will lead to coiling at the last printing unit and then to a further tear in the web.

Severing and halting devices are known which sever the web being processed between the printing units and the dryer and then grip it. This means that trouble due to the length of the web being processed present in the dryer is prevented. The risk of coiling in the last printing unit is tolerated, since here only the length present between the printing units may be coiled in a single layer. However at high machine speeds there is a thickness of the coil which may lead to machine damage.

SHORT SUMMARY OF THE INVENTION

One object of the invention is to provide a device with which, even in the case of high speed printing equipment with long dryers damage to the printing units may be effectively banished should the web being processed tear.

In order to achieve this and/or other objects appearing from the present specification, claims and drawings, in the present invention a web catching device and a severing and halting device, placed downstream from it in the direction of web travel are arranged between the last printing unit and the dryer, and furthermore a tear detector, causing the web catching device and the severing and halting device to operate in sequence, is provided.

When the invention is employed the web catching device causes the length, present in the printing unit, of the web being processed to be coiled up on the take up roll. When this happens owing to the take up roll the length running to the dryer will be promptly drawn taut so that in this condition it may be neatly cut athwart the length direction of the web being processed by the severing means, taking effect with a slight time delay, of the severing and halting device. The length, which is in any case short, located between the take up roll and the severing and halting device, of the web being processed, will therefore not have any oblique torn edge which during further coiling of the length coming from the printing units would cause the same to be drawn more strongly on one side so that danger of tearing may be prevented, more particularly adjacent to the draw in mechanism. The severing and halting device in this case not only ensures that no pieces of web may be drawn into the the dryer, but furthermore that the length present in the dryer is not moved out of the dryer, for example by nozzles blowing air. For the removal of such length the dryer does not consequently have to be opened.

Preferably the web tear detector includes a sensor responsive to the web being processed without making contact and which operates a control unit causing operation of the control unit of the severing and halting device with a small delay in time. Accordingly the device in accordance with the invention means that there are extremely short response times.

In accordance with one possible form of the invention the control unit possesses a time delay member for the control of the severing and halting device. In accordance with an alternative form of the invention a severing and halting device is adapted to operate on the basis of a built in response lag.

It is an advantage if the web catching device possesses a take up roll driven by means of a motor at a peripheral speed greater than the speed of the web. This measure means that the length, running to the draw in unit, of the web being processed is smartly drawn taut at the instant of response of the device so that despite the disengagement of the printing unit cylinder and the accompanying tendency of the length to flutter, winding may take place without folding. This measure simultaneously aids in drawing taut the length running to the dryer and accordingly helps in ensuring that a neat cut is produced by the severing and halting device.

In accordance with a still further development of the invention the speed of rotation of the motor may be steplessly varied; the control unit then possesses a control member adapted to reduce the peripheral speed of the take up roll, after detection of the web being processed, to the speed of running of the web. Accordingly there is an avoidance of an acceleration, otherwise caused by an increase in the effective diameter of wind up of the take up roll, of the length, present the printing units, of the web being processed, which acceleration might otherwise lead to a further tear in the web.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
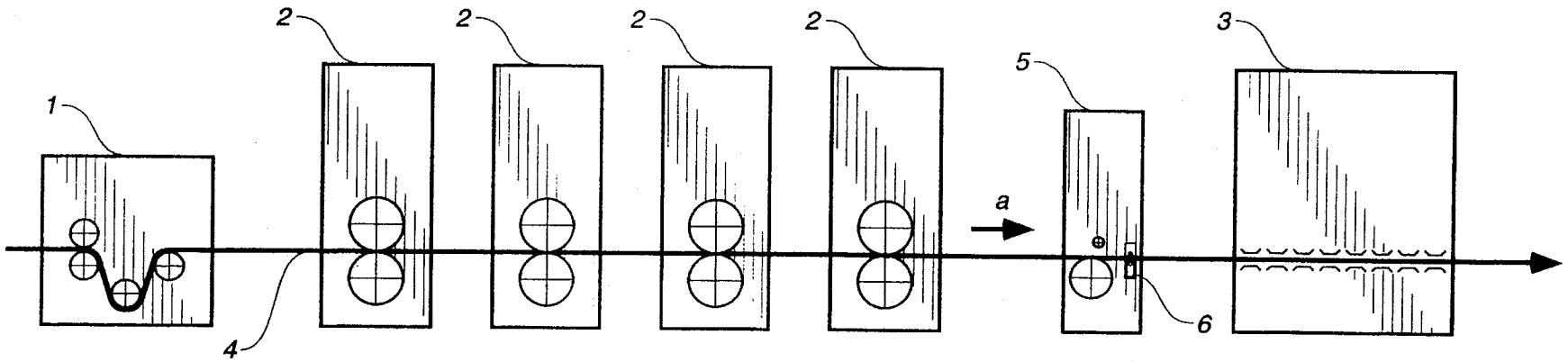
FIG. 1 shows a diagrammatic lateral elevation of a web feed rotary offset printing press.

The web feed rotary offset printing press in accordance with FIG. 1 comprises a draw in unit 1, several printing units 2 and a dryer 3. The arrangement is such that a web being processed 4 runs linearly in the direction of the arrow a through the printing units 2 and the dryer 3. Between the last printing unit 2 and the dryer 3 there is a web catching device generally referenced 5 and a severing and halting device generally referenced 6. In this respect the severing and halting device 6 is arranged downstream from the web catching device 5 in the direction a of passage of the web. The two devices 5 and 6 are preferably arranged directly adjacent to one another so that between them only a short piece of the web 4 is located. For reasons of simplicity of mounting on the printing press the web catching device 5 and the severing and halting device 6 are combined together as a single sub-assembly. The invention may however be applied to other types of printing press as well.

Figure 2:
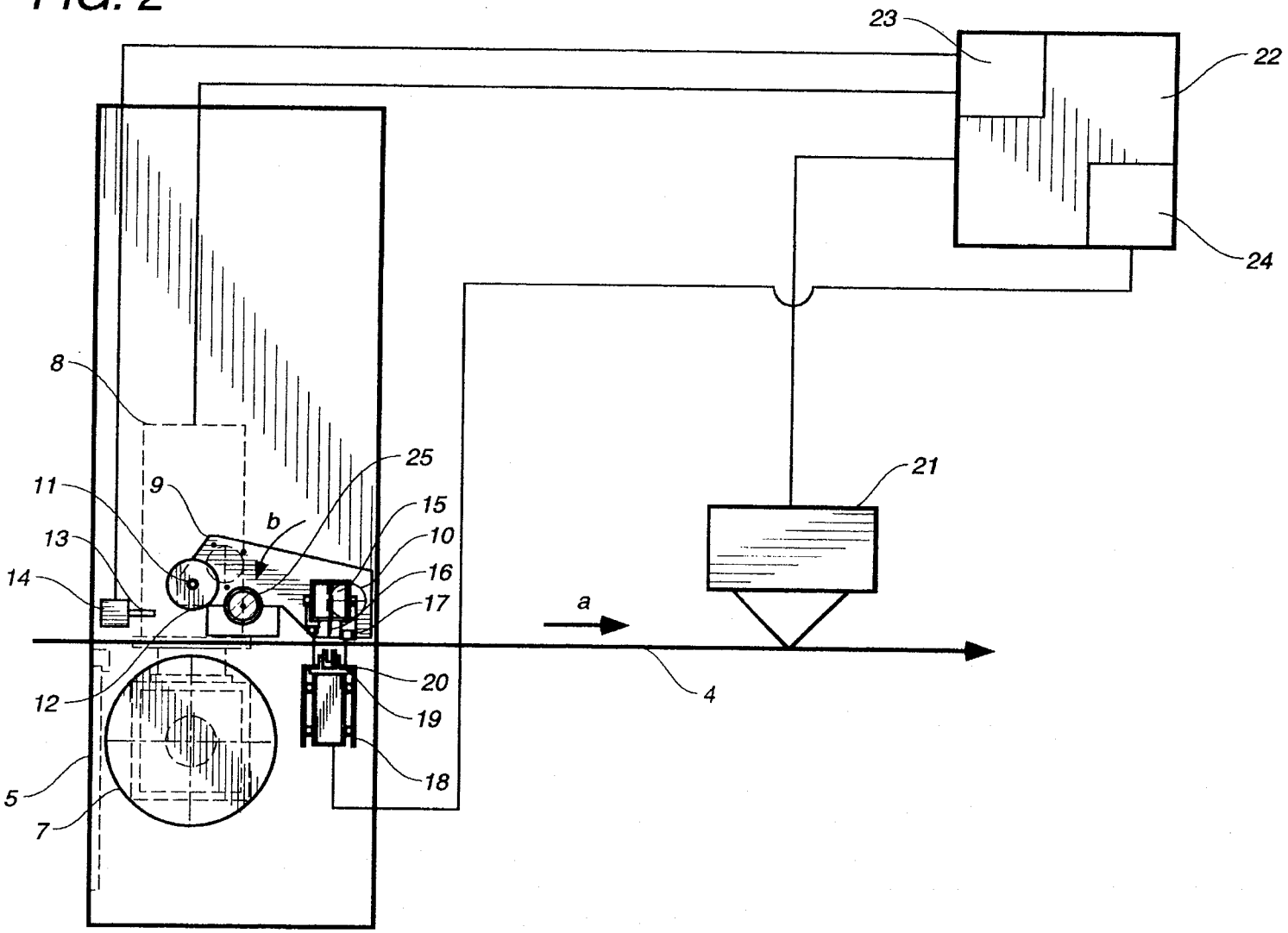
FIG. 2 shows the device in accordance with the invention on a larger scale, also in a diagrammatic lateral elevation.

As shown in FIG. 2, the web catching device 5 possesses a take up roll 7, which in the neutral position illustrated in FIG. 2 does not contact the web being processed. The take up roll 7 is driven by means of a motor 8 via a drive transmission chain (not illustrated) having gear wheels, such motor being for example a geared electric motor. The web catching device furthermore comprises a pivot frame 9, which is able to be pivoted about a fixed shaft 10. The pivot frame 9 mounts a shaft 11, on which a cooperating thrust roll 12 is mounted for free rotation thereon. Instead of a cooperating thrust roll it would be feasible to have several cooperating thrust rolls mounted on the axis. In the neutral position of the web catching device the pivot frame 9 is subject to the action of a spring (not illustrated) on a locking pin 13 of a trip device 14, for example an electromagnet or a hydraulic or pneumatic drive cylinder. If the locking pin 13 is retracted the pivot frame 9 may be rocked in the direction of the arrow b and then thrust the web 4 being processed against the take up roll 7. Instead of the web catching device as described it would be possible to employ any other type of known catching device.

As considered in the direction a of travel of the web the severing and halting device 6 is arranged immediately adjacent to the web catching device 5. The former comprises a stationarily arranged cutter bar 15 with a knife 16 and—on the side facing the dryer—a gripper rail 17.

A reciprocating beam 18 is positioned below the cutter bar 15. The reciprocating beam 18 is arranged so as to be able to move inwardly (opposite to the direction of the arrow c). At the top such beam bears a cooperating holder 19, which for cutting cooperates with the knife 16, and a gripping surface 20, between which and the gripping rail 17 the web may be held. Instead of the depicted severing and halting device 6 it would be feasible as well to employ other known severing and halting devices, which sever the web being processed and hold the length running to the dryer.

For the control of the web catching device 6 and of the severing and halting device 7 a web tear detector 21 is provided, which in the working embodiment is in the form of a sensor adapted to scan the web 4 being processed without making contact therewith. The web tear detector 21 is preferably arranged between the severing and halting device 6 and the dryer 3. The tear detector 21 responds to a web tear by providing a trip signal to a control unit 22. This control unit 22 comprises a microprocessor 23, which when a trip signal is generated by the web tear detector, operates the trip device 14 so that the locking pin 13 is retracted. It is now possible for the pivot frame 9 to be pivoted in the direction of the arrow b and accordingly, by way of the cooperating thrust roll, press the web being processed 4 against the take up roll 7. Then a bar-like guide member 25 mounted on the pivot frame 9 may move the web being processed 4 over a comparatively large peripheral area against the take up roll 7. It should be noted that at the point at which the web 4 is processed adjacent the take up roll 7, the ink on the web 4 (before the drier 3) is not yet dry. When the web 4 is brought into contact with the take up roll 7, the wet ink causes the web 4 to stick to the roller 7. Since the contact surface of the web 4 with the take up roll 7 is larger than the contact surface of the smaller thrust roll 12, the web 4 remains stuck to the larger roll 7.

In the illustrated working embodiment of the invention the take up roll 7 is driven by means of the motor 8 at a peripheral speed, which is greater than the speed of running of the web being processed 4 during printing, for example by 15%. Directly following operation of the web catching device by a thrust of the web 4 being processed against the take up roll 7 by means of the cooperating thrust roll 12 the microprocessor 23 will start to reduce the speed of rotation of the motor 8 and therefore of the take up roll 7, such reduction being to a degree which determines the respective web running velocity of the web 4 being processed, which is now not being driven, taking into account the effective winding diameter, which is increased by wind up of material, of the roll 7. Therefore after the phase of increased peripheral speed of the take up roll 7 on response of the web catching device 5 the latter will not cause any acceleration of the web 4 being processed so that there is no danger of the take up roll 7 causing a further tear in the web.

The control device 22 furthermore comprises a time delay member 24, which with a small time lag operates the severing and halting device 6. Accordingly for example using a pneumatic or hydraulic cylinder or an electromagnet the cooperating holder 19 with the gripper surface 20 is moved toward the cutter bar 15. Owing to the small lag in time with which the severing and halting device 6 is caused to operate, it is possible to ensure that the web being processed is reliably engaged by the take up roll 7 and that the same may exert a tension force, opposite to the direction a of running of the web, on the length of the web 4 being processed which is in the dryer 3. The web 4 being processed is therefore drawn taut adjacent to the knife 16 so that it is possible to produce a neat cut athwart the direction of travel of the web 4 being processed. The short portion of the web 4 being processed present between the take up roll 7 and the cooperating thrust roll 12 and the knife 16 when the web catching device 5 is operated, can not owing to the cut, which is made at a right angle to the direction of running of the web, cause a one-sided increase in the diameter of the taken up material on the take up roll 7, which increase could lead to a pulling force, which would be unequal in the width direction, on the length of the web 4 being processed in the printing units 2. The danger of further tearing of the web 4 being processed adjacent to the drawn in unit is consequently prevented. Instead of a time delay member 24 it is also possible to employ a severing and halting device 6 whose time delay is so large that cutting of the web 4 being processed only takes place when the take up roll 7 has engaged the web 4 being processed over such a peripheral area that further take up is ensured.

As will be seen from the above account the invention is not limited to the working embodiment illustrated.

I claim:

1. An apparatus for preventing damage to a rotary printing press having a web passing at a speed and in a direction therethrough, the apparatus comprising:

a printing unit;

a dryer;

a web catcher having a take up roll and a motor means, said motor means for driving said take up roll at a peripheral speed in excess of the speed of the web;

a severing and halting means positioned on a side of said web catcher between said web catcher and said dryer, said web catcher and said severing and halting means positioned between said printing unit and said dryer; and web tear detector means positioned on a side of said severing and halting means opposite said web catcher, said web tear detector means for transmitting a signal to said web catcher and to said severing and halting means upon detecting a tear in the web, said severing and halting means for severing the web upon receipt of the signal from said web tear detector means, said take-up roll receiving the web thereon upon receipt of the signal, said web detector means further comprising:

a sensor means positioned adjacent the web for scanning the web without contact therewith; and control means electricity connected to said sensor means and to said web catcher and said severing and halting means, said control means for actuating said web catcher and said severing and halting means upon receiving the signal from said sensor means; and time delay means electricity connected to said control means, said time delay means for delaying the actuation of said severing and halting means until after the actuation of said web catcher.

2. The apparatus of claim 1, said control means connected to said motor means of said web catcher for reducing the peripheral speed of said take up roll to the speed of the web upon detection by said sensor means of the web passing therethrough.

3. The apparatus of claim 1, said control means being a microprocessor.

4. The apparatus of claim 1, said web catcher and said severing and halting means being formed together in a single assembly between said dryer and said printing unit.

5. The apparatus of claim 1, said severing and halting means comprising:

a knife positioned adjacent one side of the web passing therethrough, said knife having one side facing said web catcher and another side facing said dryer.

6. The apparatus of claim 5, said severing and halting means further comprising:

a gripping rail connected to said another side of said knife, said gripping rail movable in correspondence with a movement of the knife.

* * * * *